US006079821A

United States Patent [19]

Chwalek et al.

[11] Patent Number: 6,079,821

[45] Date of Patent: Jun. 27, 2000

[54] CONTINUOUS INK JET PRINTER WITH ASYMMETRIC HEATING DROP DEFLECTION

[75] Inventors: James M. Chwalek, Pittsford; David L. Jeanmaire, Brockport; Constantine N. Anagnostopoulos, Mendon, all of N.Y.

[73] Assignee: Eastman Kodak Company, Rochester, N.Y.

[21] Appl. No.: 08/954,317

[22] Filed: Oct. 17, 1997

[51] Int. Cl.[7] ..... B41J 2/105

[52] U.S. Cl. ..... 347/82

[58] Field of Search ..... 347/73, 74, 75, 347/76, 77, 78, 82, 47

[56] References Cited

U.S. PATENT DOCUMENTS

| | | | |
|---|---|---|---|
| 1,941,001 | 12/1933 | Hansell | 178/96 |
| 3,287,734 | 11/1966 | Kazan | 347/53 |
| 3,373,437 | 3/1968 | Sweet et al. | 347/74 |
| 3,416,153 | 12/1968 | Hertz et al. | 347/73 |
| 3,709,432 | 1/1973 | Robertson | 239/4 |
| 3,878,519 | 4/1975 | Eaton | 347/75 |
| 3,916,421 | 10/1975 | Hertz | 347/73 |
| 3,979,756 | 9/1976 | Helinski et al. | 347/75 |
| 4,070,679 | 1/1978 | Fan et al. | 347/75 |
| 4,148,718 | 4/1979 | Fulwyler | 209/3.1 |
| 4,230,558 | 10/1980 | Fulwyler | 209/3.1 |
| 4,318,483 | 3/1982 | Lombardo et al. | 209/3.1 |
| 4,346,387 | 8/1982 | Hertz | 347/75 |
| 4,646,106 | 2/1987 | Howkins | 347/9 |
| 5,160,939 | 11/1992 | Bajeux et al. | 347/78 |
| 5,841,452 | 11/1998 | Silverbrook | 347/47 |

FOREIGN PATENT DOCUMENTS

| | | |
|---|---|---|
| 56-21866 | 2/1981 | Japan . |

*Primary Examiner*—N. Le
*Assistant Examiner*—Anh T. N. Vo
*Attorney, Agent, or Firm*—Milton S. Sales

[57] ABSTRACT

Apparatus for controlling ink in a continuous ink jet printer includes an ink delivery channel; a source of pressurized ink communicating with the ink delivery channel; a nozzle bore which opens into the ink delivery channel to establish a continuous flow of ink in a stream, the nozzle bore defining a nozzle bore perimeter; and a heater which causes the stream to break up into a plurality of droplets at a position spaced from the nozzle bore. The heater having a selectively-actuated section associated with only a portion of the nozzle bore perimeter, whereby actuation of the heater section produces an asymmetric application of heat to the stream to control the direction of the stream between a print direction and a non-print direction.

12 Claims, 12 Drawing Sheets

CONTINUOUS INK JET PRINTER WITH ASYMMETRIC HEATING DROP DEFLECTION

CROSS REFERENCE TO RELATED APPLICATIONS

Reference is made to commonly assigned, co-pending U.S. patent application Ser. No. 08/955,562 filed Oct. 17, 1997 entitled CONTINUOUS INK JET PRINTER WITH ELECTROSTATIC DROP DEFLECTION in the names of J. Chwalek and C. Anagnostopoulos; Ser. No. 08/953,525 filed Oct. 5, 1997 entitled CONTINUOUS INK JET PRINTER WITH VARIABLE CONTACT DROP DEFLECTION in the names of G. Hawkins, C. Anagnostopoulos, J. Chwalek, and D. Jeanmaire; Ser. No. 08/954,681 filed Oct. 17, 1997 entitled CONTINUOUS INK JET PRINTER WITH MICROMECHANICAL ACTUATOR DROP DEFLECTION in the names of J. Chwalek, G. Hawkins, and C. Anagnostopoulos; and Ser. No. 08/953,610 filed Oct. 17, 1997 entitled CONTINUOUS INK JET PRINTER WITH BINARY ELECTROSTATIC DEFLECTION in the names of J. Chwalek and D. Jeanmaire. All of the above-listed applications are filed concurrently herewith.

FIELD OF THE INVENTION

This invention relates generally to the field of digitally controlled printing devices, and in particular to continuous ink jet printheads which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging tunnels, deflection plates are used to actually deflect drops.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. In the current invention, the electrostatic charging tunnels are unnecessary.

DISCLOSURE OF THE INVENTION

It is an object of the present invention to provide a high speed apparatus and method of page width printing utilizing a continuous ink jet method whereby drop formation and deflection may occur at high repetition.

It is another object of the present invention to provide an apparatus and method of continuous ink jet printing with drop deflection means which can be integrated with the printhead utilizing the advantages of silicon processing technology offering low cost, high volume methods of manufacture.

It is still another object of the present invention to provide an apparatus and method for continuous ink jet printing that does not require electrostatic charging tunnels.

According to one feature of the present invention, apparatus for controlling ink in a continuous ink jet printer includes an ink delivery channel; a source of pressurized ink communicating with the ink delivery channel; a nozzle bore which opens into the ink delivery channel to establish a continuous flow of ink in a stream, the nozzle bore defining a nozzle bore perimeter; and a droplet generator which causes the stream to break up into a plurality of droplets at a position spaced from the ink stream generator. The droplet generator includes a heater having a selectively-actuated section associated with only a portion of the nozzle bore perimeter, whereby actuation of the heater section produces an asymmetric application of heat to the stream to control the direction of the stream between a print direction and a non-print direction.

According to another feature of the present invention, a process for controlling ink in a continuous ink jet printer includes establishing a continuous flow of ink in a stream which breaks up into a plurality of droplets at a position spaced from the ink stream generator; and asymmetrically applying heat to the stream before the position whereat the stream breaks up into droplets to thereby control the direction of the stream between a print direction and a non-print direction.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2(*b*) shows a top view of the nozzle with asymmetric heating deflection.

FIG. 6(*b*) is an image, obtained experimentally, of the asymmetric heating deflection with power supplied to the heater.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
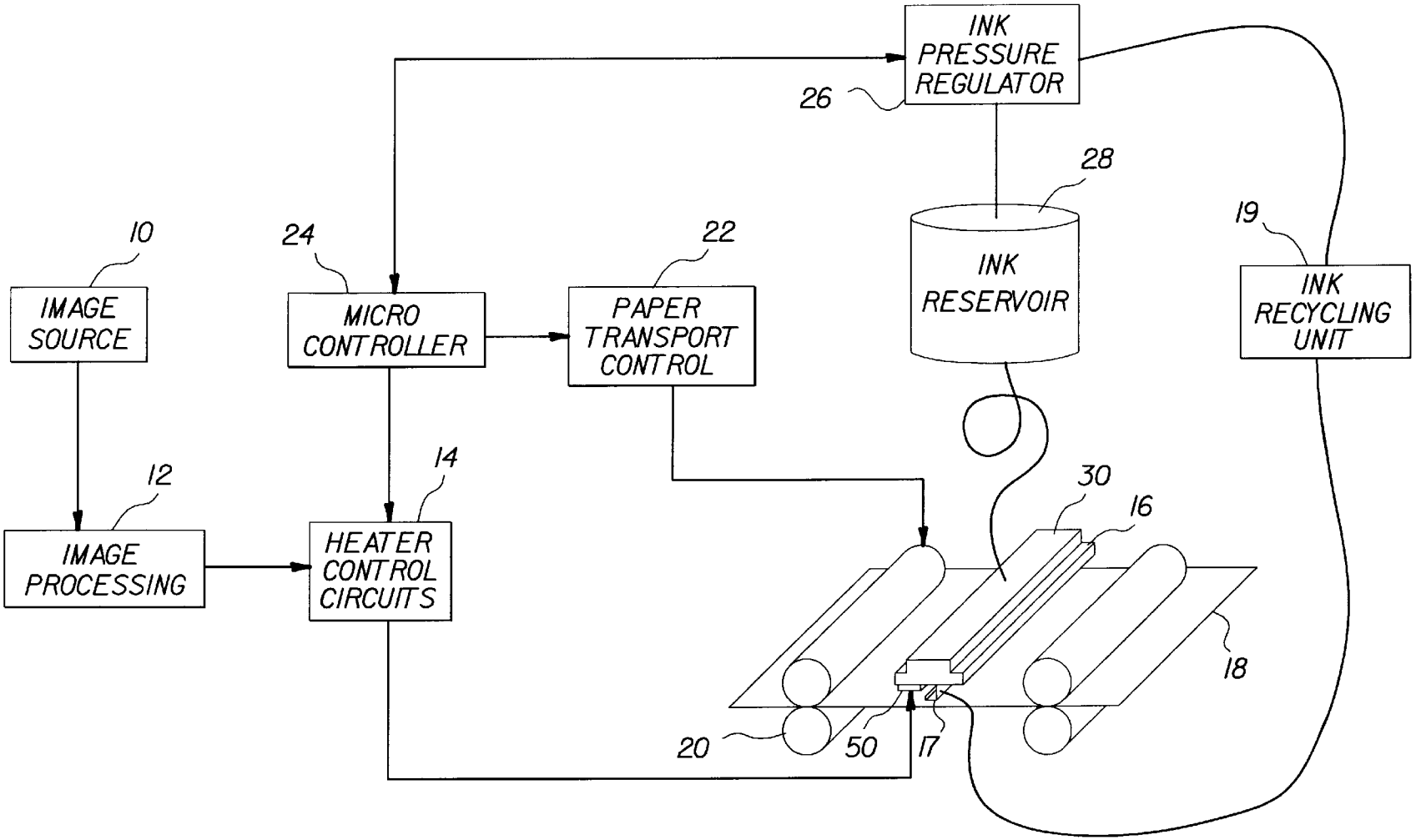
FIG. 1 shows a simplified block schematic diagram of one exemplary printing apparatus according to the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a printhead 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to printhead 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from silicon, it is possible to integrate heater control circuits 14 with the printhead.

Figure 2A:
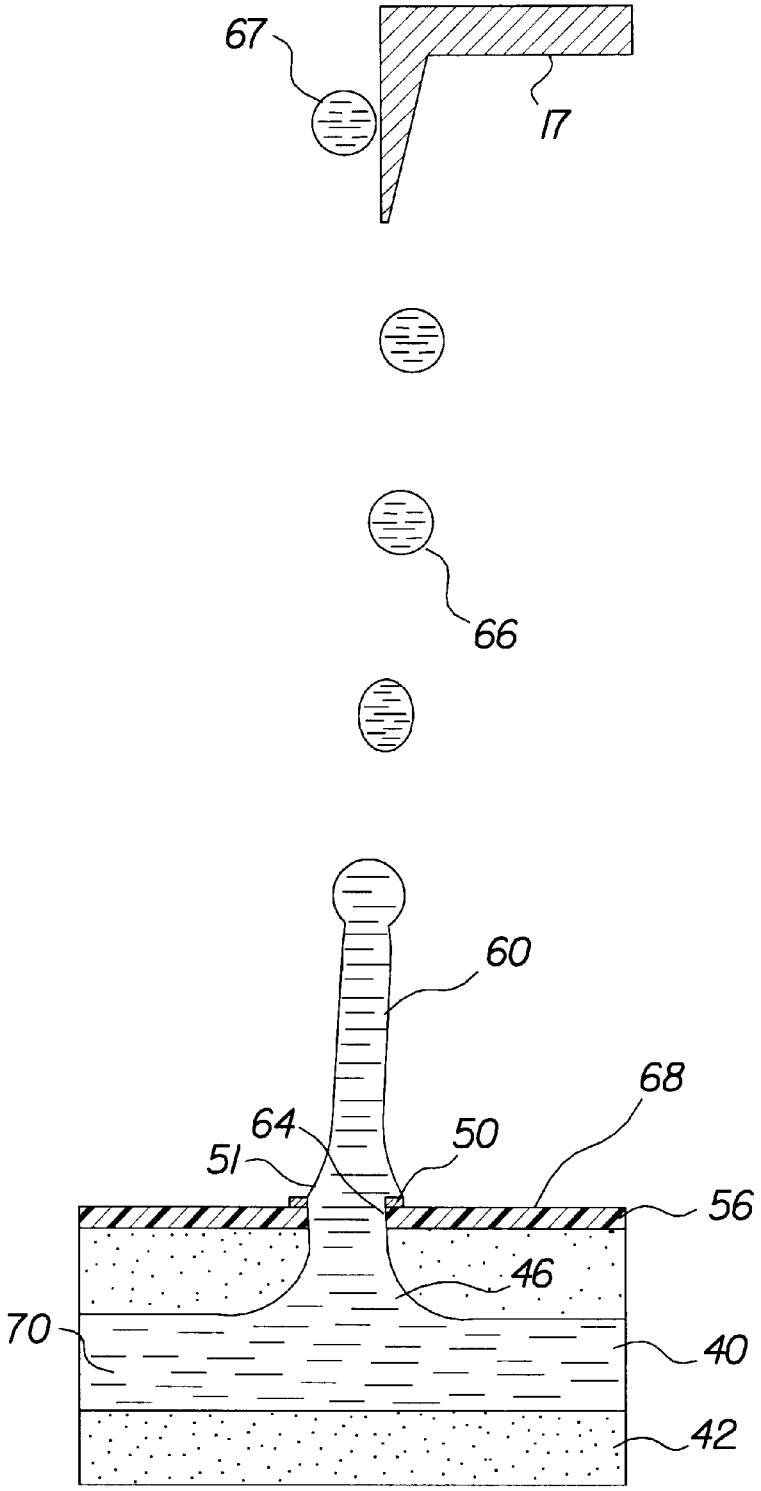
FIG. 2(*a*) shows a cross section of a nozzle with asymmetric heating deflection.
Figure 2B:
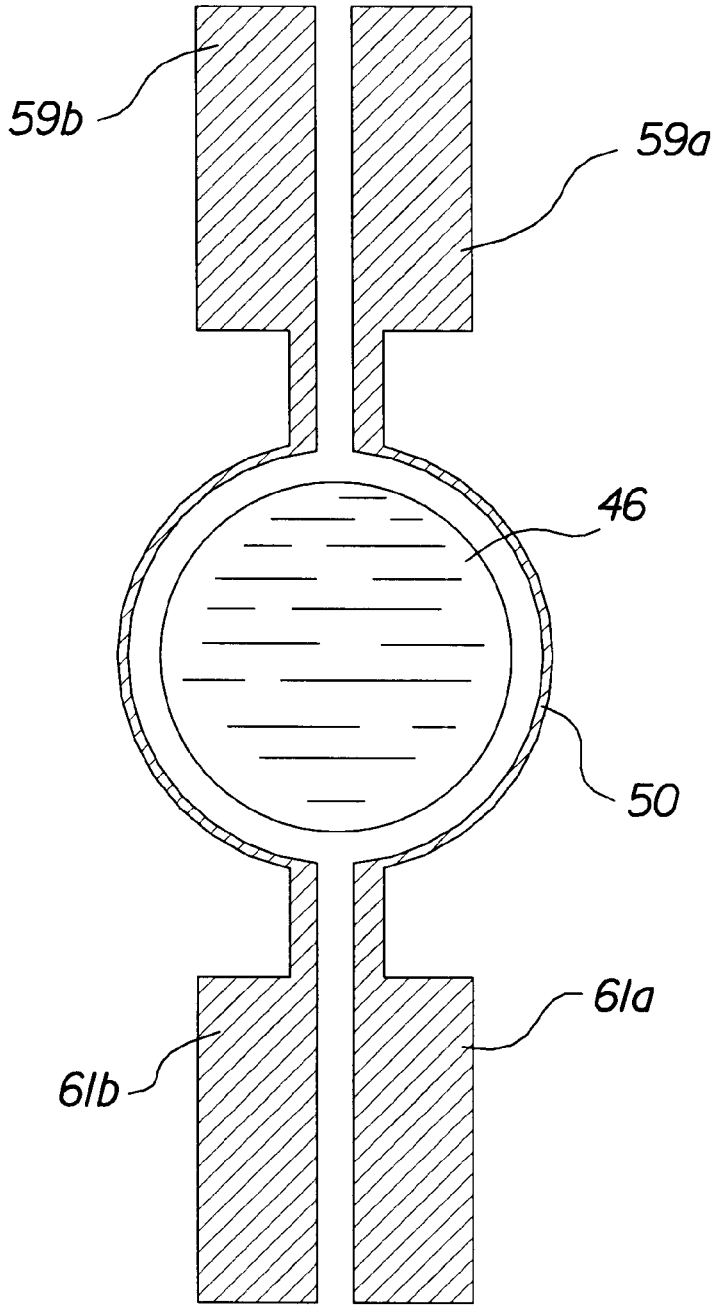

FIG. 2(*a*) is a cross-sectional view of one nozzle tip of an array of such tips that form continuous ink jet printhead 16 of FIG. 1 according to a preferred embodiment of the present invention. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to heat supplied by a heater 50.

Referring to FIG. 2(*b*), the heater has two sections, each covering approximately one-half of the nozzle perimeter. Power connections 59*a* and 59*b* and ground connections 61*a* and 61*b* from the drive circuitry to heater annulus 50 are also shown. Stream 60 may be deflected by an asymmetric application of heat by supplying electrical current to one, but not both, of the heater sections. This technology is distinct from that of prior systems of electrostatic continuous stream deflection printers, which rely upon deflection of charged drops previously separated from their respective streams. With stream 60 being deflected, drops 66 may be blocked from reaching recording medium 18 by a cut-off device such as an ink gutter 17. In an alternate printing scheme, ink gutter 17 may be placed to block undeflected drops 67 so that deflected drops 66 will be allowed to reach recording medium 18. Ink droplets traveling along a path such that the droplets reach recording medium 18 are considered to travel in a "print direction" while ink droplets traveling along a path such that the droplets do not reach the recording medium are considered to travel in a "non-print direction."

The heater was made of polysilicon doped at a level of about thirty ohms/square, although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56.

The layers in contact with the ink can be passivated with a thin film layer 64 for protection. The printhead surface can be coated with a hydrophobizing layer 68 to prevent accidental spread of the ink across the front of the printhead.

Figure 3:
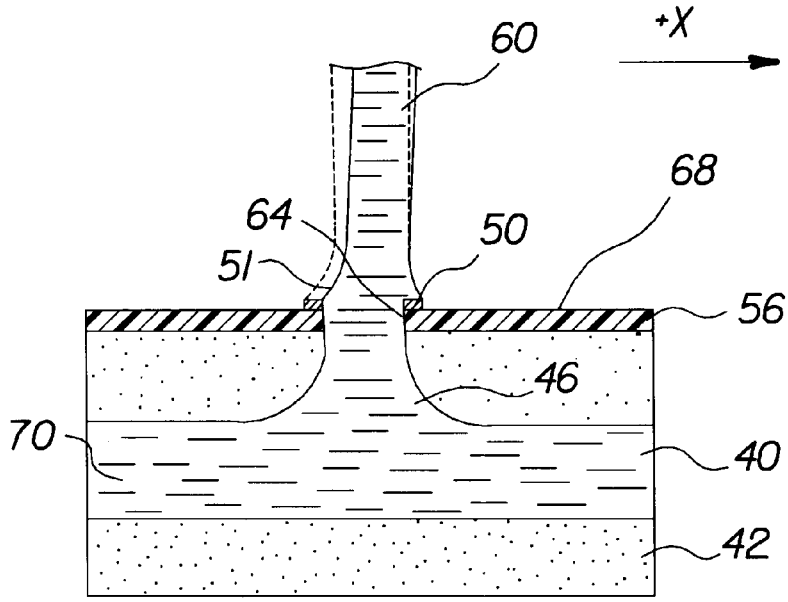
FIG. 3 is an enlarged cross section view of the nozzle with asymmetric heating deflection.

FIG. 3 is an enlarged view of the nozzle area. A meniscus 51 is formed where the liquid stream makes contact with the heater edges. When an electrical pulse is supplied to one of the sections of heater 50 (the left-hand side in FIG. 3), the contact line that is initially on the outside edge of the heater (illustrated by the dotted line) is moved inwards toward the inside edge of the heater (illustrated by the solid line). The other side of the stream (the right-hand side in FIG. 3) stays pinned to the non-activated heater. The effect of the inward moving contact line is to deflect the stream in a direction away from the active heater section (left to right in FIG. 3 or in the +x direction). At some time after the electrical pulse ends the contact line returns toward the inside edge of the heater.

In this example, the nozzle is of cylindrical form, with the heater section covering approximately one-half the nozzle perimeter. By increasing the heater width, a larger change in radius and hence deflection is possible up to the point where meniscus 51 in the non-heated state (dotted line in FIG. 3) cannot wet to the outside edge of heater 50. Alternatively, heater 50 may be positioned further away from the edge of nozzle bore 46, resulting in a larger distance (for the same heater width) to the outside edge of heater 50. This distance may range from approximately 0.1 $\mu$m to approximately 3.0 $\mu$m. It is preferred that the inside edge of heater 50 be close to the edge of nozzle bore 46 as shown in FIG. 3. The optimal distance from the edge of nozzle bore 46 to the outside edge of the heater will depend on a number of factors including the surface properties of heater 50, the pressure applied to the ink, and the thermal properties of the ink.

Heater control circuit 14 supplies electrical power to the heater as shown in FIG. 2(*a*). The time duration for optimal operation will depend on the geometry and thermal properties of the nozzles, the pressure applied to the ink, and the thermal properties of the ink. It is recognized that minor experimentation may be necessary to achieve the optimal conditions for a given geometry and ink.

Deflection can occur by applying electrical power to one or both heaters as shown in the timing diagram of FIGS. 4(*a*) to FIG. 4(*b*), which represent the electrical pulse train applied power connections 59*a* and 61*a* on one side of the nozzle and to power connections 59*b* and 61*b* on the other side of the nozzle. The arrow designates the point in time in which drop deflection occurs. In FIG. 4(*a*), both sides of the heater receive equal electrical pulses, and hence heat, for the first two pulses shown. The next pulse is applied only to one side of the heater, causing an asymmetric heating condition. This results in deflection of the drop corresponding to this pulse. FIG. 4(*b*) illustrates an alternative pulsing scheme, whereby the quiescent state of the nozzle is an asymmetrically heated state, and deflection to the opposite side occurs whenever a pulse is applied to the opposite heater while the first heater has no pulse applied during that interval.

It is also possible to achieve drop deflection by employing a nozzle with a heater surrounding only one-half of the nozzle perimeter. FIG. 4(*c*) illustrates the pulsing scheme which can be utilized in the case of a heater surrounding one-half of the nozzle perimeter. The quiescent or non-deflected state utilizes pulses of sufficient amplitude to cause drop breakup, but not enough to cause significant deflection. When deflection is desired, a larger amplitude pulse is applied to the heater to cause a larger degree of asymmetric heating.

FIG. 4(*d*) illustrates electrical pulse trains whereby side 1 utilizes pulses of sufficient amplitude to cause drop breakup, but not enough to cause significant deflection. When drop deflection is desired, a larger amplitude pulse is applied to the heater of side 2 to cause a larger degree of asymmetric heating.

Another example of an electrical pulse train that can achieve drop deflection by employing a nozzle with a heater surrounding only one-half of the nozzle perimeter is shown in FIG. 4(*e*). The quiescent state utilizes pulses that are of sufficient pulsewidth to cause drop breakup, but not enough to cause significant deflection. When deflection is desired, a longer pulsewidth is applied to the heater to cause a larger degree of asymmetric heating.

Examples of CMOS circuits that can be integrated with silicon printhead 16 to produce the waveforms of FIGS. 4(*a*)–4(*d*) are shown in FIGS. 5(*a*)–5(*d*). The circuit shown in FIG. 5(*a*) will produce the waveforms shown in FIG. 4(*a*). The circuit consists of one shift register stage 11 which is loaded with an ONE or a ZERO depending on whether the droplet of the nozzle corresponding to this stage of the shift register should be deflected or not. It is understood that the shift register has at least as many stages as the number of nozzles in a row. The data from the shift register is captured by a latch circuit 9 at the moment a latch clock 10 is applied. At this point, new data can be loaded into the shift register for the next line to be printed. When an enable clock 8, which runs in synchronism with the line clock f1, occurs, the data Q from latch circuit 9 propagates through an AND gate 7 and an inverter 6 onto the gate of a MOS switch 1. If the data Q is a ONE, then switch 1 turns off and simultaneously switch 12 turns on, which puts zero volts on the gate of a driver transistor 3, thus turning it off and cutting off any current flow through side 1 of the heater. The right side of the heater is pulsed constantly once per line time since MOS switch 2 is always on because its gate is connected to the +V supply. In case the data Q is a ZERO, then reset transistor 12 is off and MOS switch 1 is on, thus allowing f1 to drive the gate of driver 3. In this case, since both sides of the heater see the same signal, the droplet from this nozzle is not deflected.

To obtain the waveforms shown in FIG. 4(*b*), the circuit of FIG. 5(*b*) may be utilized This circuit is similar to the one of FIG. 5(*a*), except that the gate of switch 2 is now connected to the output of the AND gate and a reset transistor 13 has been added. If the data Q is a ONE, that is the droplet should be deflected, then switch 2 turns on allowing driver transistor 4 to turn on and thus current to flow through side 2 of the heater. No current is allowed to flow through side 1 of the heater, however, because the switch 1 is turned off and reset transistor 12 keeps gate of driver 3 grounded. If the data Q is a ZERO, then side 1 of the heater is pulsed while side 2 does not draw any current.

The circuit shown in FIG. 5(*c*) produces the waveform of FIG. 4(*c*). In this case, side 2 of the heater is inactive. Driver transistors 3 and 4 differ. Driver 4 is smaller than driver 3, which translates to a higher resistance or lower current driving capability. Thus, driver 4 is sized to drive enough current through the heater to cause stable droplet formation, but not enough to cause stream deflection. Driver 3 on the other hand, is much larger, thus having lower resistance and higher current driving capability. It is sized to cause stream deflection. Thus, as long as the data Q is a ZERO, only driver 4 is on, but when Q is a ONE, then driver 3 turns on and much more current flows through the heater, causing deflection of the droplet.

In FIG. 5(*d*), the functions of stable droplet formation and stream deflection are separated. Thus, side 2 heater receives constantly a small pulse, enough for stable droplet formation. This is accomplished by making driver transistor 4 small. Driver 3 on the other hand is sized to cause deflection when it is turned on. This circuit configuration reduces the total energy required for operation by separating the functions of droplet formation and deflection.

Experimental Results

Figure 6A:
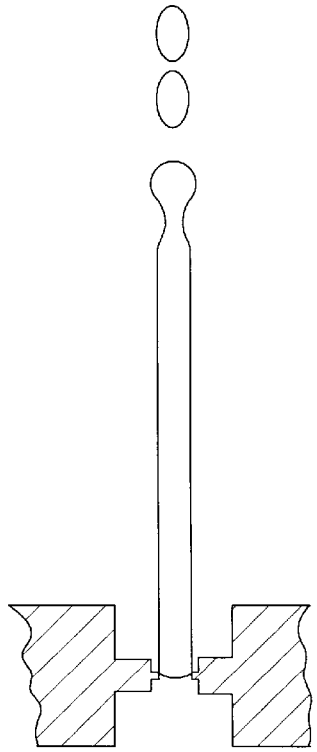
FIG. 6(*a*) is an image, obtained experimentally, of asymmetric heating deflection with no power supplied to the heater.
Figure 6B:
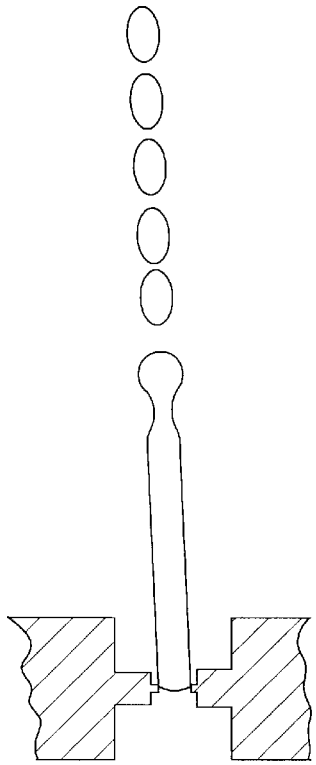

A print head with approximately 14.3 $\mu$m diameter nozzle bore, a heater width of approximately 0.65 $\mu$m, and a distance from the edge of nozzle bore 46 to the outside edge of heater 50 of approximately 1.5 $\mu$m was fabricated as described above with the heater surrounding one-half of the nozzle perimeter. An ink reservoir and pressure control was used to control the pressure of stream 60. A fast strobe and a CCD camera were used to freeze the image of the drops in motion. A heater power supply was used to provide a current pulse train to heater 50. The ink reservoir was filled with DI water and a pressure of 135.0 kPa (19.6 lbs/in$^2$) was applied forming a stream as can be seen from FIG. 6(*a*). A series of 3.0 $\mu$s duration pulses at a repetition rate of 200 KHz and a power of approximately 108 mW was applied to heater 50, which caused the stream to break up into a series of regularly spaced drops and deflect at an angle of 2.2 degrees away from the active heater half, as can be seen from FIG. 6(*b*) (the active heater is on the left side of the streams in FIGS. 6(*a*) and 6 (*b*)).

Figure 7:
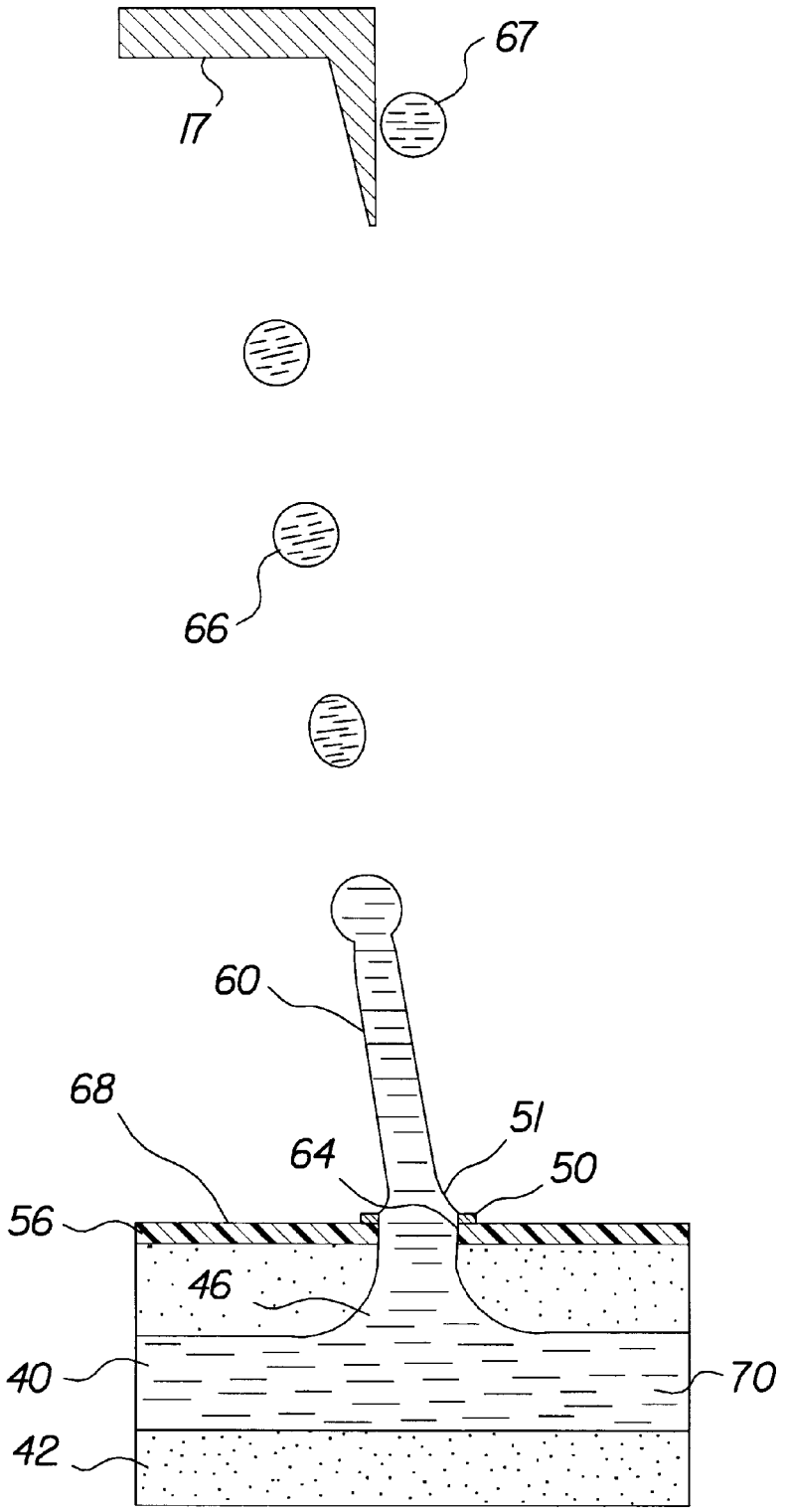
FIG. 7 shows a cross section view of the nozzle according to another embodiment of the present invention.

FIG. 7 is a cross-sectional view of a single nozzle tip of continuous ink jet printhead 16 according to another embodiment of the present invention. Like numbers correspond to like parts in FIG. 7 and FIG. 2(*a*).

The nozzle is fabricated in a similar manner as described above. An ink delivery channel 40, along with a plurality of nozzle bores 46 are etched in a substrate 42 which is silicon in this example. Delivery channel 40 and nozzle bore 46 are formed by anisotropic wet etching of silicon, using a $p^+$ etch stop layer to shape nozzle bore 46. Ink 70 in delivery channel 40 is pressurized above atmospheric pressure, and forms stream 60. At a distance above nozzle bore 46, stream 60 breaks into drops 66 due to heat supplied by heater 50. The heater is comprised of two sections, each covering approximately one-half the nozzle perimeter (FIG. 2(*b*)). Stream 60 may be deflected by supplying electrical current to one but not simultaneously to both of the heater sections. With stream 60 being deflected, drops 66 may be blocked from reaching recording medium 18 by ink gutter 17. In an alternate printing scheme, ink gutter 17 may be placed to block undeflected drops 67 so that deflected drops 66 will be allowed to reach the recording medium.

Figure 8:
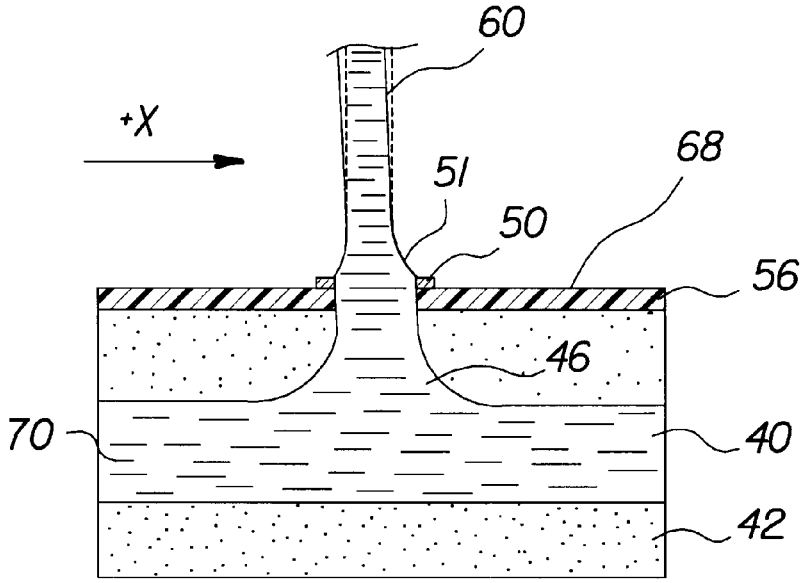
FIG. 8 is an enlarged cross section view of the nozzle according to another embodiment of the present invention.
Figure 4A:
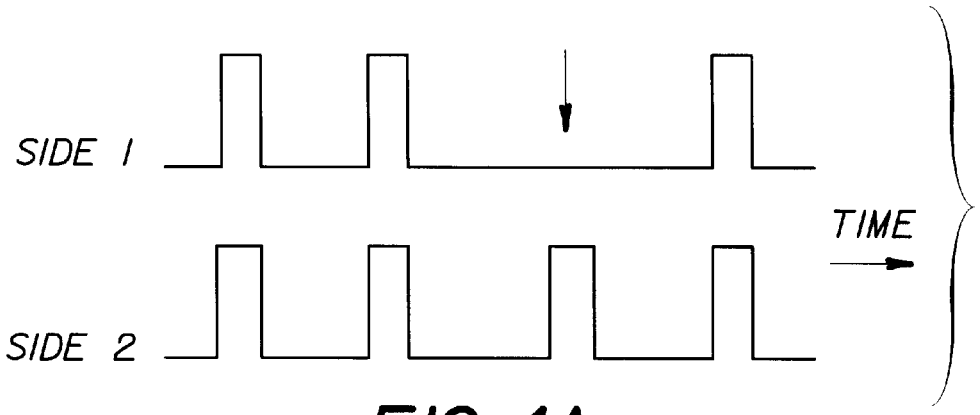
FIGS. 4(*a*)–4(*e*) illustrate example electrical pulse trains applied to the heater for a nozzle with asymmetric heating deflection.
Figure 4B:
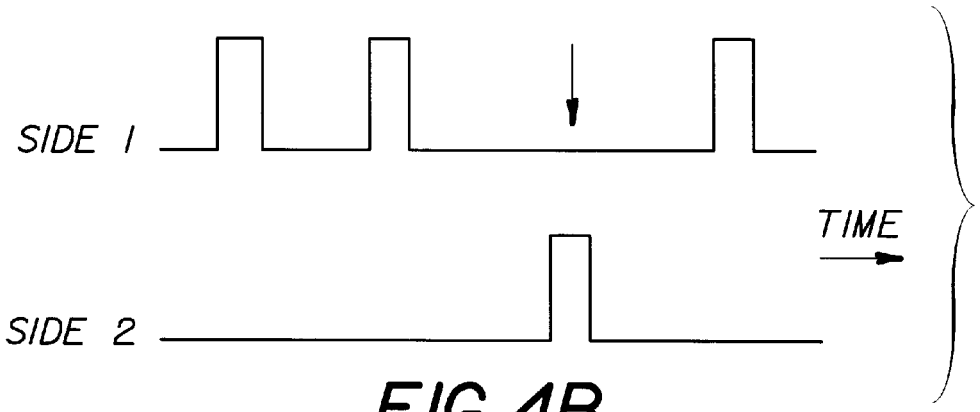
Figure 4C:
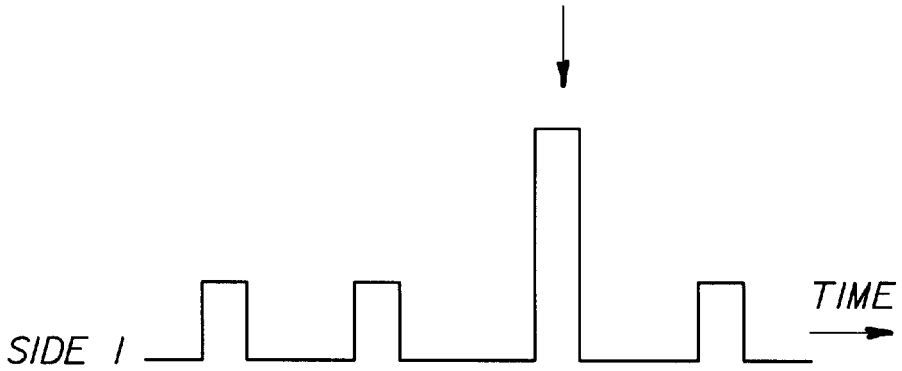
Figure 4D:
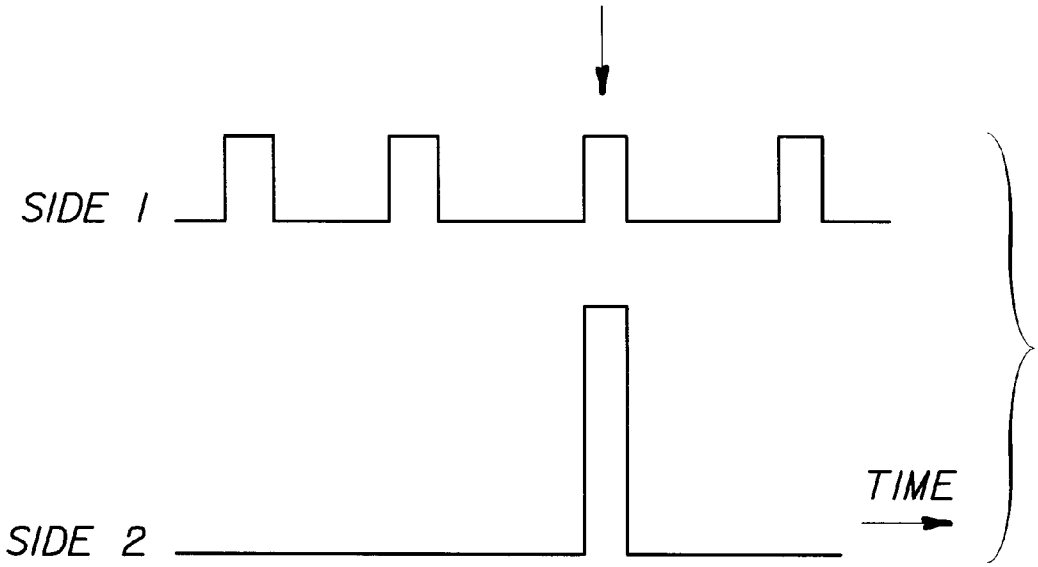
Figure 4E:
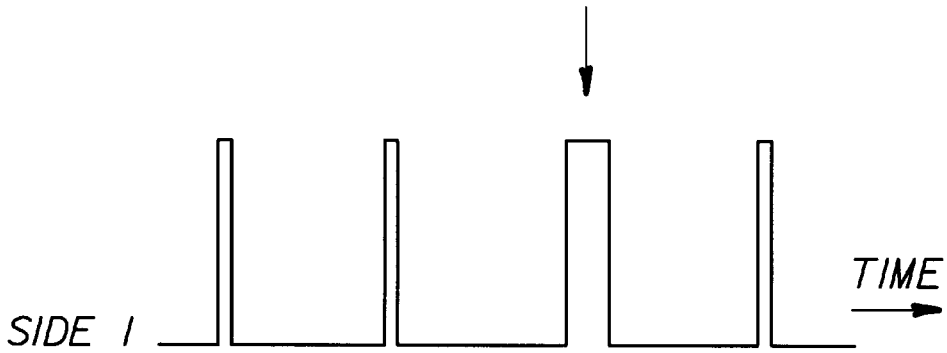
Figure 5A:
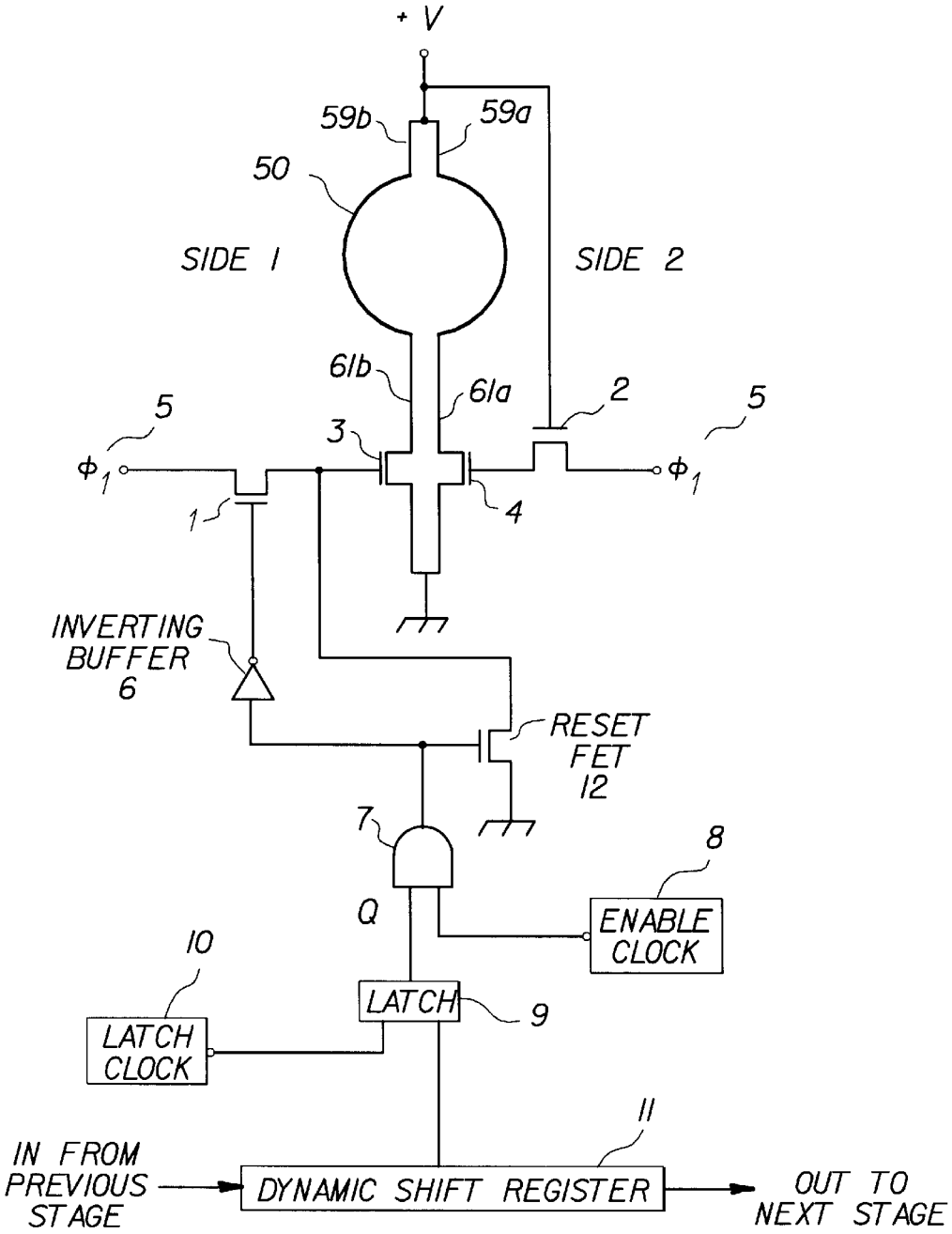
FIGS. 5(*a*)–5(*d*) are schematic diagrams of circuits to produce the example electrical pulse trains.
Figure 5B:
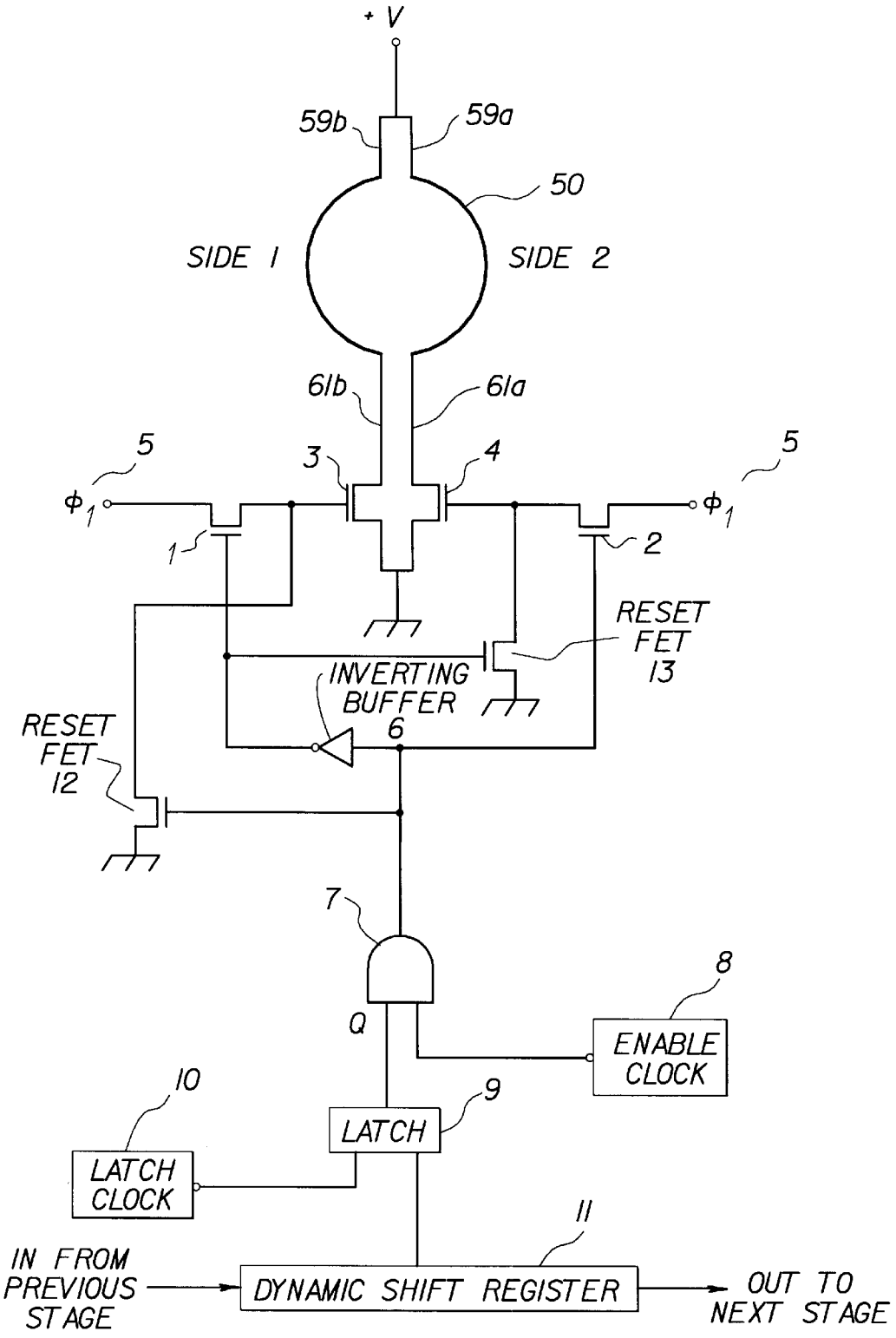
Figure 5C:
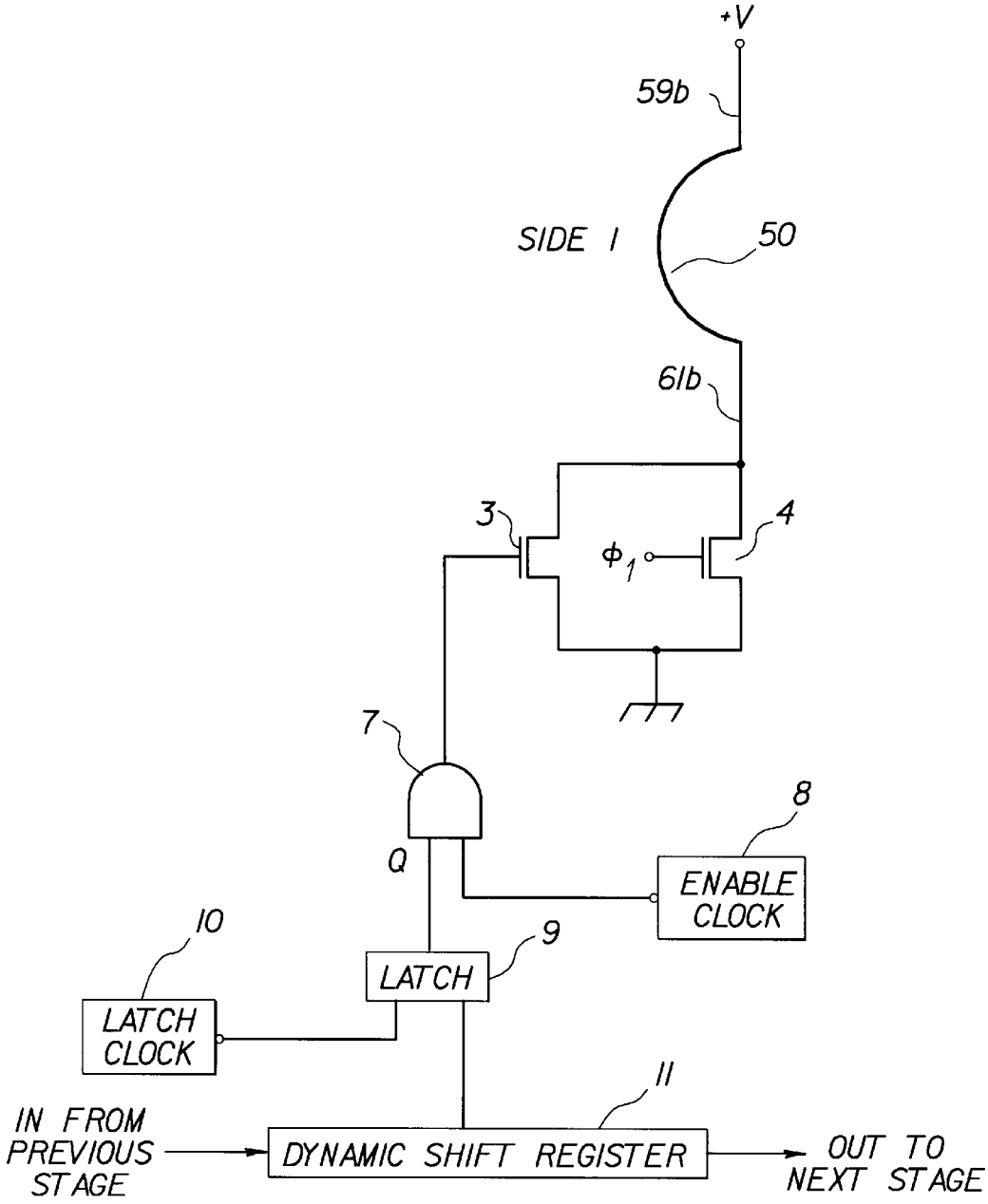
Figure 5D:
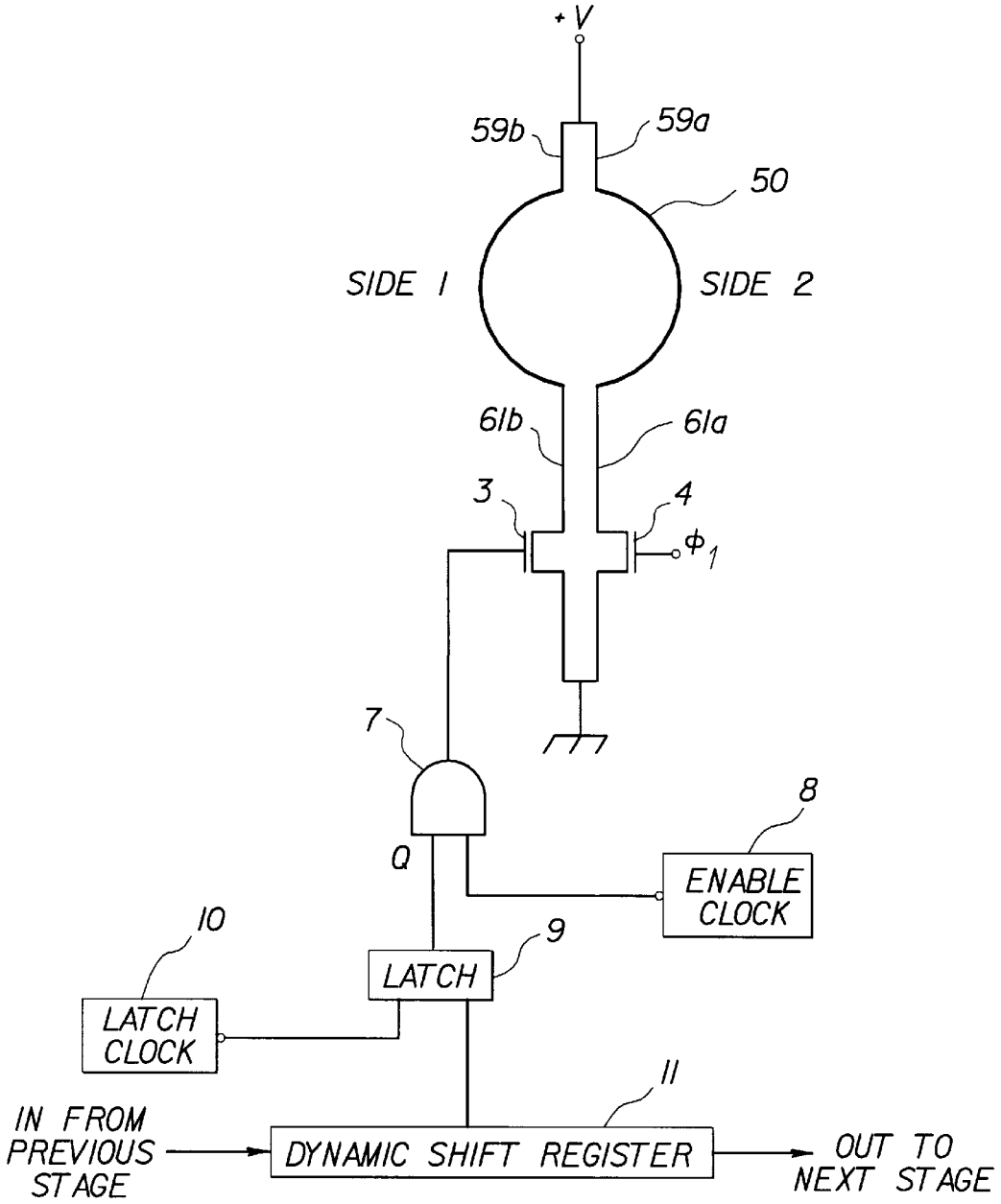

FIG. 8 is an enlarged view of the nozzle area the deflection in this alternate embodiment. In this case, the contact line does not move. It stays pinned, for example, on the inside edge of both heaters 50. One way this may be accomplished is by using heater widths that are large enough such that meniscus 51 (see FIG. 8) cannot wet to the outside edge of heater 50. Alternatively, the heater may be positioned further away from the edge of nozzle bore 46 resulting in a larger distance (for the same heater width) to the outside edge of heater 50. This distance may usefully range from approximately 3.0 $\mu$m to approximately 6.0 $\mu$m. It is preferred that the inside edge of both sections of the heater 50 is close to the edge of nozzle bore 46 as shown in FIG. 8. The optimal distance from the edge of nozzle bore 46 to the outside edge of the will depend on a number of factors including the surface properties of heater 50, the thermal properties of the ink including surface tension, and the pressure applied to the ink. It is recognized that other geometries are possible to provide pinning of meniscus 51 such as a ridge formed on either the inside or outside edge of the heater. When an electrical pulse is supplied to one of sections of heater 50 (the left-hand side in FIG. 8) the stream is deflected from the initial non-heated state (dotted lines) to the heated state (solid lines) or from right to left in FIG. 8 (i.e., −x direction). Note that this direction is opposite to the deflection direction that is detailed in the first embodiment of the present invention.

As in the previous examples, the nozzle is of cylindrical form, with the heater covering approximately one-half of the nozzle perimeter. The heater was made of polysilicon doped at a level of about 30 ohms/square although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56. The layers in contact with the ink can be passivated with a thin film layer 64 for protection. The print head surface can be coated with a hydrophobizing layer 68 to prevent accidental spread of the ink across the front of the print head.

Heater control circuits 14 supplies electrical power to the heater sections at a given power and time duration. The time duration and power level for optimal operation will depend on the geometry and thermal properties of the heater and nozzles, the thermal properties of the ink including surface tension, as well as, the pressure applied to the ink.

Experimental Results

A print head with approximately 14.5 $\mu$m diameter nozzle bore, a heater width of approximately 1.8 $\mu$m, and a distance from the edge of nozzle bore 46 to the outside edge of heater 50 of approximately 2.6 $\mu$m was fabricated as described above with the heater surrounding one-half of the nozzle perimeter. An ink reservoir and pressure control means was used to control the pressure of stream 60. A fast strobe and a CCD camera were used to freeze the image of the drops in motion. A heater power supply was used to provide a current pulse train to heater 50. The ink reservoir was filled with DI water and a pressure of 48.2 kPa (7.0 lbs/in$^2$) was applied. A series of 2.0 $\mu$s duration pulses at a repetition rate of 120 KHz and a power of approximately 97 mW was applied to heater 50 which caused the stream to break up into a series of regularly spaced drops and deflect at an angle of 0.15 degrees in a direction toward the active heater half.

Although an array of streams is not required in the practice of this invention, a device comprising an array of streams may be desirable to increase printing rates. In this case, deflection and modulation of individual streams may be accomplished as described for a single stream in a simple and physically compact manner, because such deflection relies only on application of a small potential, which is easily provided by conventional integrated circuit technology, for example CMOS technology.

The invention has been described in detail with particular reference to preferred embodiments thereof, but it will be understood that variations and modifications can be effected within the spirit and scope of the invention.

What is claimed is:

1. Apparatus for controlling ink in a continuous ink jet printer in which a continuous stream of ink is emitted from a nozzle; said apparatus comprising:

an ink delivery channel;

a source of pressurized ink communicating with the ink delivery channel;

a nozzle bore which opens into the ink delivery channel to establish a continuous flow of ink in a stream, the nozzle bore defining a nozzle bore perimeter; and a heater which causes the stream to break up into a plurality of droplets at a position spaced from the nozzle bore, said heater having a selectively-actuated section associated with only a portion of the nozzle bore perimeter, whereby actuation of the selectively-actuated section of the heater produces an asymmetric application of heat to the stream to control direction of the stream between a print direction and a non-print direction.

2. Apparatus as set forth in claim 1, wherein the plurality of ink droplets travel along a path in either the print direction or in the non-print direction, and further comprising an ink gutter in the path of ink droplets traveling in only said non-print direction.

3. Apparatus as set forth in claim 1, wherein said heater has a two selectively-actuated sections which are independently actuatable and positioned along respectively different portions of the nozzle bore perimeter, whereby selective actuation of the heater sections produces an asymmetric application of heat to the stream to control the direction of the stream between the print direction and the non-print direction.

4. A process for controlling ink in a continuous ink jet printer in which a continuous stream of ink is emitted from a nozzle; said process comprising:

establishing the continuous stream of ink flow from a nozzle bore, said stream breaking up into a plurality of ink droplets at a position spaced from the nozzle bore; and asymmetrically applying heat to the stream before the position whereat the stream breaks up into droplets such that the plurality of ink droplets travel along either a print direction or a non-print direction.

5. The process as set forth in claim 4, wherein the step of establishing a continuous stream of ink comprises:

providing an ink delivery channel;

providing a source of ink communicating with the ink delivery channel;

pressurizing the ink in the delivery channel above atmospheric pressure; and providing a nozzle bore opening into the ink delivery channel.

6. The process as set forth in claim 5, wherein the plurality of ink droplets travel along a path in either the print direction or in the non-print direction, and further comprising providing an ink gutter in the path of ink droplets traveling in said non-print direction.

7. A process for controlling ink in a continuous ink jet printer in which a continuous stream of ink is emitted from a nozzle; said process comprising:

establishing a continuous flow of ink in a stream;

causing the stream to break up into a plurality of droplets at a position spaced from the nozzle; and asymmetrically applying heat to the stream before the position whereat the stream breaks up into droplets to thereby control the direction of the stream between a print direction and a non-print direction.

8. The process as set forth in claim 7, wherein the step of establishing a continuous stream of ink comprises:

providing an ink delivery channel;

providing a source of ink communicating with the ink delivery channel;

pressurizing the ink in the delivery channel above atmospheric pressure; and providing a nozzle bore opening into the ink delivery channel.

9. The process as set forth in claim 8, wherein the plurality of ink droplets travel along a path in either the print direction or in the non-print direction, and further comprising providing an ink gutter in the path of ink droplets traveling in said non-print direction.

10. Apparatus for controlling ink in a continuous ink jet printer in which a continuous stream of ink is emitted from a nozzle; said apparatus comprising:

a substrate having an upper surface;

an ink delivery channel within said substrate;

a source of pressurized ink communicating with the ink delivery channel;

a nozzle bore in said substrate, said nozzle bore opening into the ink delivery channel to establish a continuous flow of ink in a stream, the nozzle bore defining a nozzle bore perimeter; and a heater which causes the stream to break up into a plurality of droplets at a position spaced from the nozzle bore, said heater having a selectively-actuated section associated with only a portion of the nozzle bore perimeter such that actuation of the selectively-actuated section of the heater produces an asymmetric application of heat to the stream to control the direction of the stream between a print direction and a non-print direction, said heater being positioned on top of the upper surface of the substrate thereby to form an edge at which ink may pin spaced from the nozzle bore.

11. Apparatus as set forth in claim 10, wherein the heater is separated from the substrate by a thermal and electrical insulating layer.

12. Apparatus as set forth in claim 10, wherein said heater has a two selectively-actuated sections which are independently actuatable and positioned along respectively different portions of the nozzle bore perimeter, whereby selective actuation of the heater sections produces an asymmetric application of heat to the stream to control the direction of the stream between a print direction and a non-print direction.

* * * * *